United States Patent [19]

Broersma

[11] Patent Number: 4,627,115

[45] Date of Patent: Dec. 9, 1986

[54] VENTILATED HELMET

[75] Inventor: Lester V. Broersma, Bellflower, Calif.

[73] Assignee: Bell Helmets Inc., Norwalk, Calif.

[21] Appl. No.: 769,386

[22] Filed: Aug. 26, 1985

Related U.S. Application Data

[63] Continuation of Ser. No. 572,893, Jan. 23, 1984, Pat. No. 4,555,816.

[51] Int. Cl.[4] ..... A42B 3/02

[52] U.S. Cl. ..... 2/425; 2/414; 2/424; 2/171.3

[58] Field of Search ..... 2/425, 424, 414, 410, 2/411, 412, 171.4, 171.7, 171.3, 10, 6

[56] References Cited

U.S. PATENT DOCUMENTS

| | | | |
|---|---|---|---|
| 2,777,127 | 1/1957 | Marietta | 2/6 X |
| 3,806,949 | 4/1974 | Bushman | 2/414 |
| 3,984,875 | 10/1976 | Farquharson | 2/10 |
| 4,081,865 | 4/1978 | Bergee | 2/425 |
| 4,115,874 | 9/1978 | Hasegawa | 2/425 |
| 4,404,690 | 9/1983 | Farquharson | 2/425 X |
| 4,434,514 | 3/1984 | Sundahl et al. | 2/425 |
| 4,519,099 | 5/1985 | Kamiya et al. | 2/425 X |

FOREIGN PATENT DOCUMENTS

| | | | |
|---|---|---|---|
| 0072767 | 2/1983 | European Pat. Off. | 2/425 |
| 3233467 | 3/1984 | Fed. Rep. of Germany | 2/410 |

OTHER PUBLICATIONS

Nava, "The New Nava 2AC With Air Control", 1984.

*Primary Examiner*—Peter Nerbun
*Attorney, Agent, or Firm*—William W. Haefliger

[57] ABSTRACT

A cyclist's helmet incorporates a dome shaped top wall structure, opposite side wall structures, a front opening for forward viewing, a lower front wall structure which extends forwardly and a rear wall structure. It also includes:

(a) a frontward facing air inlet means defined by said wall structure, and an air outlet means defined by said wall structure generally rearwardly of said lower front wall structure, and (b) passage means in said wall structure including said side wall structure to receive air inflow from said inlet means for circulation to the upper interior of the helmet and subsequent flow via said wall structure and to said outlet means, (c) said inlet means, passage means, and outlet means located to enhance cooling air flow through the helmet.

11 Claims, 9 Drawing Figures

VENTILATED HELMET

This is a continuation of application Ser. No. 572,893, filed Jan. 23, 1984, now U.S. Pat. No. 4,555,816.

BACKGROUND OF THE INVENTION

This invention relates generally to helmets, and more particularly concerns a safety helmet of the type worn by bicyclists, and having a construction enhancing comfort and safety of the wearer.

In the past, it was known to provide air vents in helmets, as for example are described in U.S. Pat. No. 3,496,854 to Feldman and U.S. Pat. No. 3,925,821 to Lewicki. Such helmets lack the unusually advantageous features of construction, beneficial results and combinations thereof as are now provided by the present helmet, these including enhanced safety and air cooling.

SUMMARY OF THE INVENTION

It is a major object of the invention to provide an improved helmet incorporating all of the above referenced advantages and results. Basically, the helmet incorporates a dome shaped top wall structure, opposite side wall structures, a front opening for forward viewing, a lower front wall structure which extends forwardly and a rear wall structure. It also includes:

(a) a frontward facing air inlet means defined by said wall structure, and an air outlet means defined by said wall structure generally rearwardly of said lower front wall structure, and (b) passage means in said wall structure including said side wall structure to receive air inflow from said inlet means for circulation to the upper interior of the helmet and subsequent flow via said wall structure and to said outlet means, (c) said inlet means, passage means, and outlet means located to enhance cooling air flow through the helmet.

As will appear, the top, side and rear wall structures are typically defined by an outer shell and an inner liner, the passages located in the liner and also between the liner and the outer shell or wall.

Further, the passage means may include passages extending rearwardly in opposite sides of the helmet lower front portion, such passages extending rearwardly from the inlet and upwardly toward the helmet interior to circulate scavenge air to the latter and provide cooling; and additional of the passages may extend generally downwardly to an outlet or outlets defined by openings through the shell defined by side wall structure. Such inlet means, passages and outlets provide for enhanced ventillation, i.e. induction of cooling air and, vacuum assisted exiting of cooling air. Finally, removable pad means may be provided in the helmet, and a removable closure for the inlet means may be enabled.

These and other objects and advantages of the invention, as well as the details of an illustrative embodiment, will be more fully understood from the following specification and drawings, in which:

DRAWING DESCRIPTION

DETAILED DESCRIPTION

Figure 1:
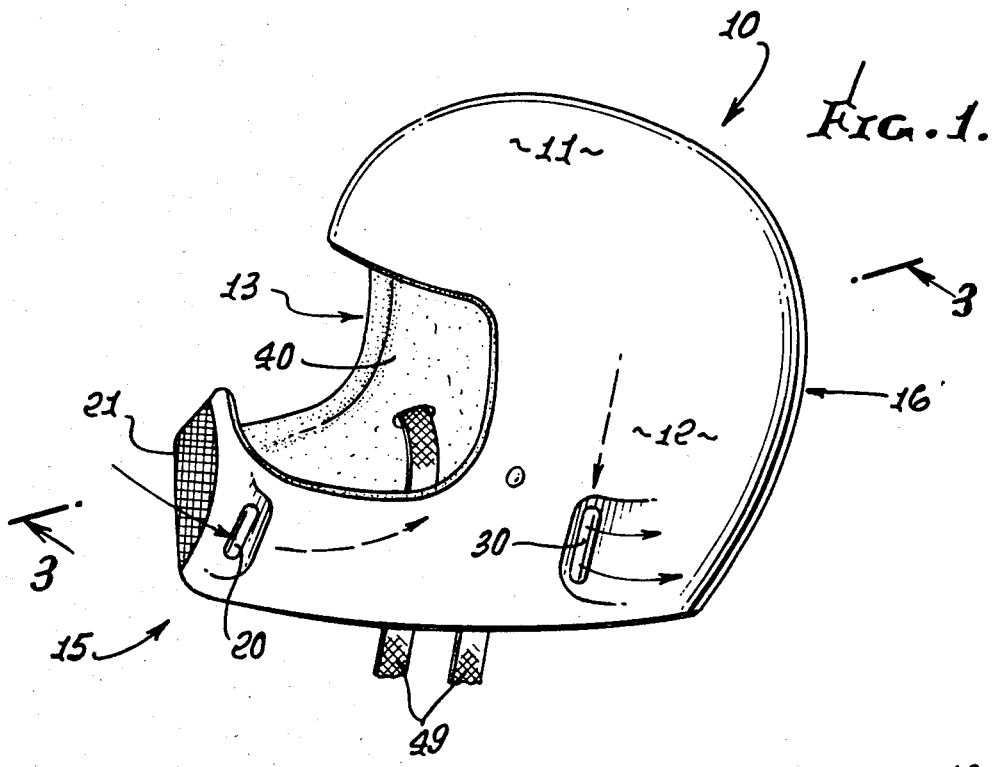
FIG. 1 is a perspective view of a helmet incorporating the invention.

In FIGS. 1–4, the helmet 10 shown is of the type worn by motorcyclists or bicyclists. It has a dome shaped top wall structure 11, opposite side wall structures 12 and 13, a front opening 14 for forward viewing, a lower front portion 15 having forwardly U-shaped wall structure which juts or projects forwardly beneath opening 14, and rear wall structure 16. Such wall structures may be defined by an outer shell, and also by an inner liner, with corresponding walls 11*a*, 11*b*; 12*a*, 12*b*; 13*a*, 13*b*; 15*a*, 15*b*; and 16*a*, 16*b*. The thin outer shell may consist of laminated, hard plastic material, and the liner may consist of softer molded plastic material such as foamed plastic (polyurethane).

In accordance with the invention, passages or channels are formed in the wall structure, with inlets and outlets, all configured to enhance cooling air flow through the helmet as by ram injection of air into the inlets, and vacuum or suction withdrawal of air from the outlets.

Figure 2:
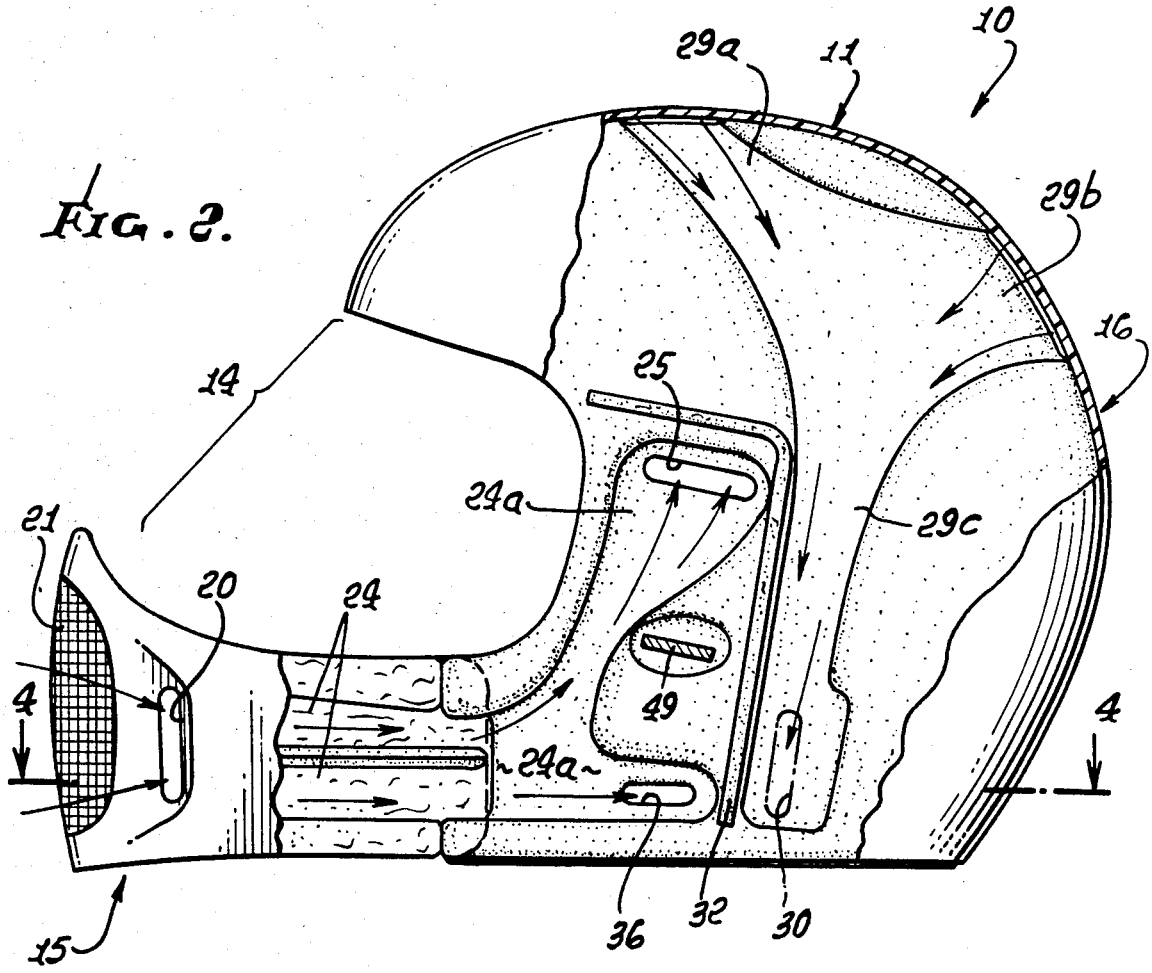
FIG. 2 is a side elevational view of the helmet, with the shell broken away in certain areas.
Figure 3:
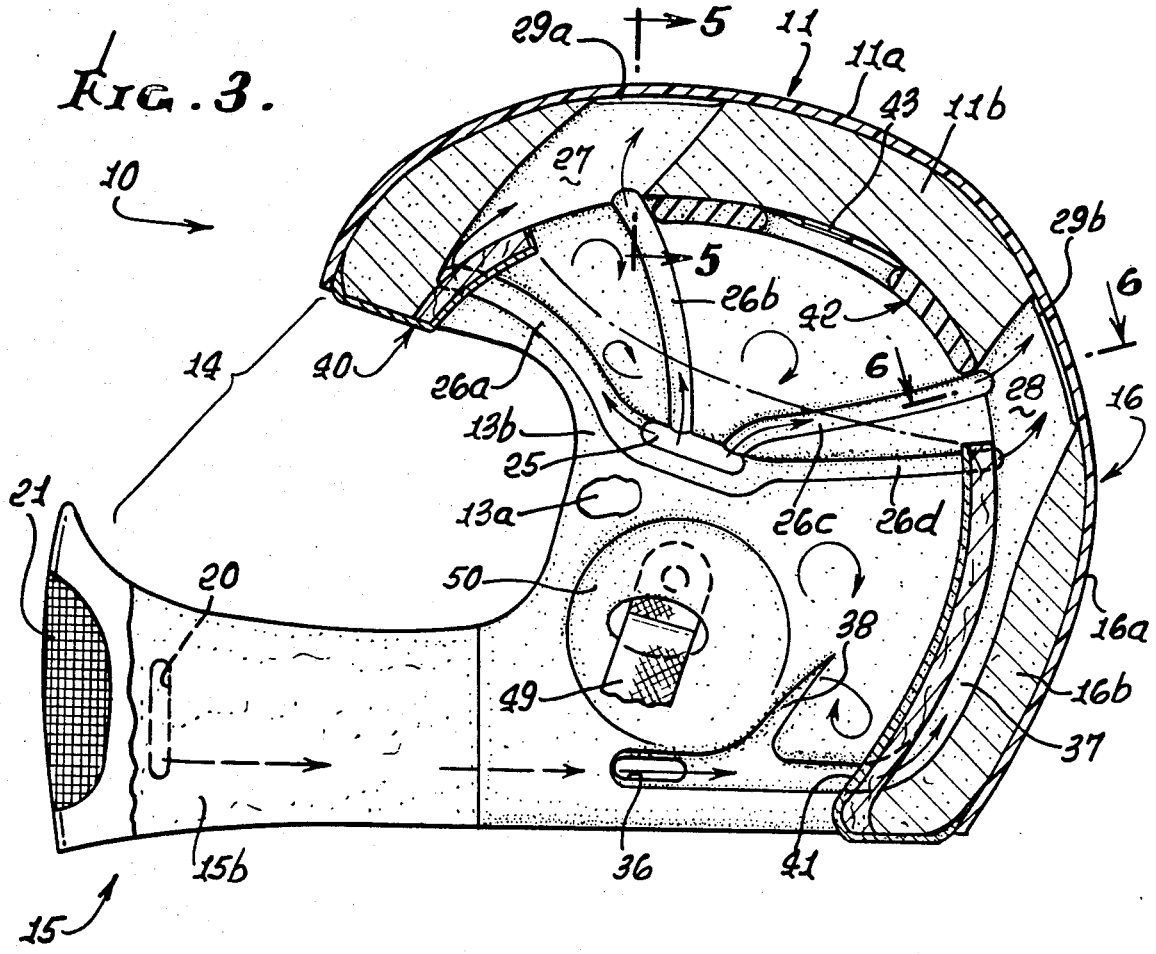
FIG. 3 is an elevation taken in section through the helmet, on lines 3—3 of FIG. 1.
Figure 4:
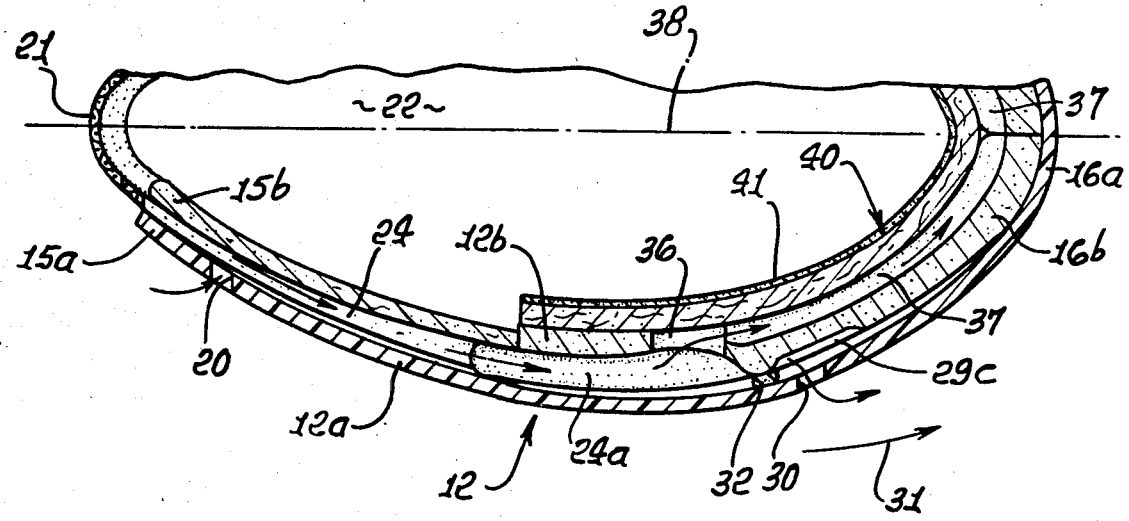
FIG. 4 is a plan view section taken on lines 4—4 of FIG. 2.
Figure 5:
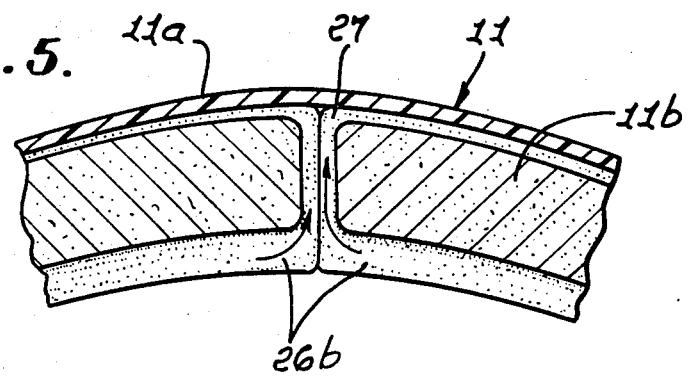
FIG. 5 is a section on lines 5—5 of FIG. 3.

More specifically, and referring to FIGS. 2 and 3, frontwardly facing air inlet means are defined as in the lower front portion of the helmet (as for example by vertically elontated recesses 20 in the liner 15*a*) rearwardly and laterally of a front screen 21. The latter admits air directly to the interior 22 of the U-shaped forward portion 15 of the helmet. The air entering inlets 20 then enters passage means in the wall structure including the side wall structure for circulation to the upper interior of the helmet and subsequent flow via the wall structure to outlet means, to be described. More specifically, air passes from inlets 20 into first portions of passage means, as for example are representated by ducts 24 cut or formed in outer surfaces of the liner, and extending rearwardly, as seen in FIGS. 2 and 4. Such ducts 24 face the shell and extend from the lower front portion 15 into the main extent of the helmet as at 24*a*. From the latter a confined duct branch 24*aa* extends upwardly, at each side of the helmet, and toward a primary opening 25 through the liner in the side wall structure to pass the entering air flow into second portions of the passage means in the liner and exposed to the helmet interior. The second portions of the passage means are for example represented by ducts 26*a*, 26*b*, 26*c* and 26*d* shown in FIG. 3 as branching from the primary opening in lining wall 13*b*. The same ducting is found in the lining wall 12*b* at the opposite side of the helmet.

Air flowing in duct branches 26*a*–26*d* sweeps warmer air from the upper interior of the helmet upwardly toward and through secondary openings through the liner. See for example openings 27 and 28 in FIG. 3, in the top and rear wall structure of the helmet. The air thus swept through openings 27 and 28 passes to third portions of the passage means between the liner and shell, and as represented by ducts 29*a*, 29*b* and 29*c* seen in FIG. 2 as merging to guide the air flow downwardly toward like outlets 30 through the shell at opposite sides of the helmet. External air flowing relatively pass outlets 30, as represented by arrow 31 in FIG. 4, tends to draw the air flow outwardly from outlets 30, as by aspiration or partial vacuum effect. Ducts 29*a*–29*c* are preferably cut or otherwise molded in the liner material to face the shell, as appears in FIG. 4, whereby the main outer surface extent of the liner remains close to the shell inner surface, to absorb impacts. See also like L-shaped seals 32 inserted between the liner and shell to block communication between ducts 29*c* and 29*a* on the one hand, and ducts 24*a*, 24*aa* and ports 25 on the other hand.

The air passage means in helmet wall structure may also, and with unusual advantage, include auxiliary openings (as at 36 for example) through the liner in the side wall structures, and below the levels of the primary openings 25. Auxiliary openings 36 pass air flow from ducts 24 to auxiliary portiors of the passage means (as exemplified by ducts 37) at the inner side of the liner defined by the rear wall structure. See FIGS. 3 and 4 in this regard. Like openings 36 and ducts 37 are found in opposite sides of the liner, i.e. at opposite sides of a vertical plane 38 bisecting the helmet. The ducts 37 extend rearwardly and upwardly to pass air to the openings 28, as shown in FIG. 3. This assists air flow through the passage means in the helmet, and to the outlets. Note also side branch 38 from which some air may circulate.

A removable pad may be inserted into the helmet, as shown at 40 in FIGS. 3 and 4, to enhance the wearer's head comfort, and also to cover the ducts 37 cut or formed in the inner side of the liner, to be exposed inwardly toward the pad. Perspiration absorbed with the pad tends to be drawn as water vapor into the ducts 37, and swept out of the helmet, i.e. the pad 40 may be porous to "breath", for this purpose. The pad may include a porous fabric inner liner 41, as shown. Liner 41 may consist of porous polypropylene, and the pad itself may consist of reticulated polyethylene foam.

Figure 8:
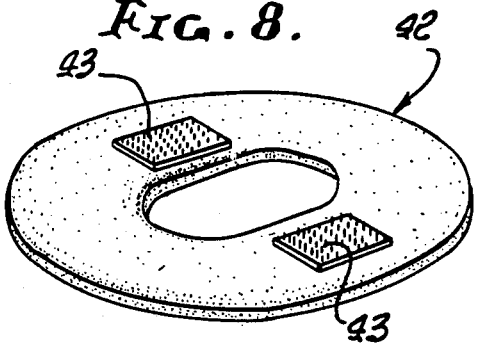
FIG. 8 is a perspective showing of a top pad as appears in FIG. 3.

A top pad 42 may be removably attached to the inner side of the upper dome extent of the liner. See FIGS. 3 and 8 showing that pad as being generally annular, and as having VELCRO layers 43 thereon to removably attached to the liner. Adhesive layers may be substituted for VELCRO layers. Pad 42 extends between openings 27 and 28.

Finally, closures 44 are removably attached or attachable to the helmet front-portion 15 to at least partially cover or plug the inlets 20, as during cold weather. Note legs 46 provided on the closure to wedge interfit with the edges of the opening 20.

Figure 7:
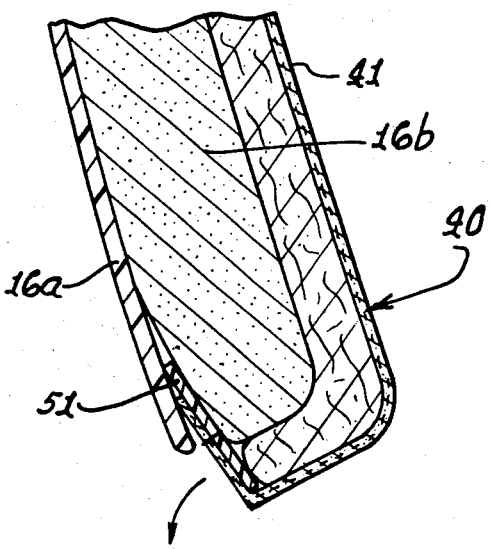
FIG. 7 is an enlarged section showing a modification.
Figure 6:
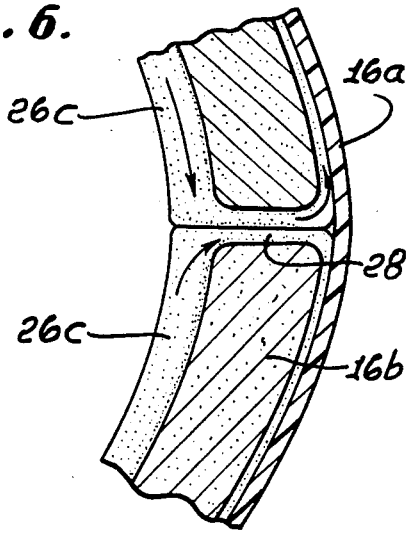
FIG. 6 is a section on lines 6—6 of FIG. 3.
Figure 9:
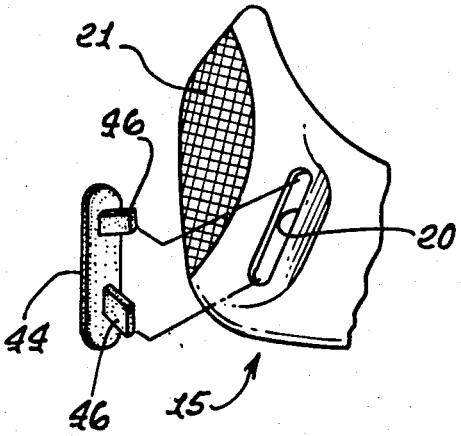
FIG. 9 is a perspective showing of an air intake with associated closure.

A helmet strap appears at 49 in FIG. 3, and an ear cavity area in the liner appears at 50. FIG. 7 shows a plastic strip 51 wedged between shell 16*a* and liner 16*b* to act as a clip retaining the pad 40 in position. Strip 51 is carried by the pad, as shown, and is removable from position between the liner and shell, to release the pad.

I claim:

1. In a motorcyclist or bicyclist helmet having dome shaped top wall structure, side wall structures, a front opening for forward viewing, a lower front wall structure which juts forwardly, and rear wall structure, the combination comprising:

(a) said wall structure defining passage means for circulating cooling air flow, and (b) removable pad means carried by the helmet to extend across at least a portion of said passage means, (c) and pad means retention structure comprising clip structure attached to the pad means and wedged upwardly between the shell and liner at a level or levels below major extent of said air flow passage means.

2. In a helmet having dome shaped top wall structure, side wall structures, a front opening for forward viewing, and rear wall structure, the wall structure defined by an outer shell and an inner liner, the combination comprising (a) removable pad means carried by the helmet to extend in the helmet interior, proximate the wearer's head, (b) and retention means on the pad means to removably attach to at least one of the liner and shell, (c) said retention means including holder means carried by said pad means lowermost extents, (d) wherein said holder means is in an upwardly wedged position and is everywhere between lowermost portions of the shell and liner and is removable from said position when removal of the pad means form the helmet is desired.

3. The combination of claim 2 wherein said pad means is porous.

4. The combination of claim 2 wherein the pad means includes a layer of reticulated foam.

5. The combination of claim 4 wherein the pad means includes a porous fabric liner, to which the clip means is attached.

6. The combination of claim 2 including cooling air flow passage means between the wall structure and the pad means.

7. The combination of claim 6 wherein the pad means is porous to said air flow, whereby perspiration may pass through the pad means to said cooling air flow passage means.

8. The combination of claim 7 wherein the helmet defined air flow inlet and outlets in communication with said air flow passage means.

9. In a helmet having dome shaped top wall structure, side wall structures, a front opening for forward viewing, and rear wall structure, the wall structure defined by an outer shell and an inner liner, the combination comprising (a) removable pad means carried by the helmet to extend in the helmet interior, proximate the wearer's head, (b) retention means on the pad means to attach to at least one of the liner and shell, (c) cooling air flow passage means between the wall structure and the pad means, the helmet defining air flow inlet and outlets in communication with said air flow passage means, (d) the pad means being porous to said air flow, whereby perspiration may pass through the pad means to said cooling air flow passage means, (e) and wherein said retention means comprises clip structure attached to the pad means and wedged upwardly between the shell and liner at a level or levels below major extent of said air flow passage means.

10. The combination of claim 6 wherein said passage means includes passages extending rearwardly from said inlet and then upwardly toward the helmet upper interior.

11. The combination of claim 10 wherein said passage means includes primary openings through said wall structure to pass air flow between portions of said passage means between said liner and shell to portions of said passage means in said liner and exposed to the helmet interior and to said pad means.

* * * * *